US009982620B2

(12) United States Patent
Flohr et al.

(10) Patent No.: US 9,982,620 B2
(45) Date of Patent: May 29, 2018

(54) METHOD FOR THE CORRECTION OF A FUEL QUANTITY INJECTED BY MEANS OF A FUEL INJECTION DEVICE DURING OPERATION OF AN INTERNAL COMBUSTION ENGINE

(71) Applicant: MTU Friedrichshafen GmbH, Friedrichshafen (DE)

(72) Inventors: Andreas Flohr, Friedrichshafen (DE); Francois Layec, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 18 days.

(21) Appl. No.: 14/766,348

(22) PCT Filed: Jan. 23, 2014

(86) PCT No.: PCT/EP2014/000171
§ 371 (c)(1),
(2) Date: Aug. 6, 2015

(87) PCT Pub. No.: WO2014/121896
PCT Pub. Date: Aug. 14, 2014

(65) Prior Publication Data

US 2015/0377167 A1 Dec. 31, 2015

(30) Foreign Application Priority Data

Feb. 7, 2013 (DE) ..... 10 2013 202 038

(51) Int. Cl.
*F02D 41/24* (2006.01)
*F02D 41/30* (2006.01)
(Continued)

(52) U.S. Cl.
CPC ..... *F02D 41/2467* (2013.01); *F02D 41/1446* (2013.01); *F02D 41/182* (2013.01);
(Continued)

(58) Field of Classification Search
CPC ..... F02D 41/2467; F02D 41/1446; F02D 41/182; F02D 41/30; F02D 2200/701;
(Continued)

(56) References Cited

U.S. PATENT DOCUMENTS 6,082,092 A * 7/2000 Vandervort ..... F02C 9/28 60/39.281
7,181,332 B1 2/2007 Vick et al.
(Continued)

FOREIGN PATENT DOCUMENTS

DE 102008032935 A1 1/2010
DE 102008060928 A1 6/2010
(Continued)

OTHER PUBLICATIONS

Wilson Ricardo Cruz et al: "A Simple 1-10 Simu Lati on Technique for Energy Balance of Internal Combustion Engines Under Variable Load", Proceedi Ngs of ECOS 2005, Jun. 20, 2005 (Jun. 20, 2005), XP055115729, Trondheim, Norway.

*Primary Examiner* — David Hamaoui
(74) *Attorney, Agent, or Firm* — Lucas & Mercanti, LLP; Klaus P. Stoffel

(57) ABSTRACT

A method for correcting a fuel quantity injected by a fuel injection device during operation of an internal combustion engine, including: determining an air heat characteristic variable, on which an air heat stream fed to a combustion chamber of the engine functionally depends; determining an exhaust heat characteristic variable, on which an exhaust heat stream discharged from the combustion chamber functionally depends; determining a heat distribution factor, which specifies a fraction of the exhaust heat stream reduced by the air heat stream in relation to a heat stream fed with the injected fuel to the combustion chamber; calculating a fuel mass fed to the engine from the air heat characteristic variable, the exhaust heat characteristic variable and the heat
(Continued)

distribution factor; calculating a comparison variable by comparing the calculated fuel mass with a fuel mass setpoint value and adapting actuation of the fuel injection device depending on the comparison variable.

14 Claims, 1 Drawing Sheet

(51) Int. Cl.
*F02D 41/14* (2006.01)
*F02D 41/18* (2006.01)

(52) U.S. Cl.
CPC ..... *F02D 41/30* (2013.01); *F02D 41/1445* (2013.01); *F02D 2200/0402* (2013.01); *F02D 2200/0406* (2013.01); *F02D 2200/0414* (2013.01); *F02D 2200/0616* (2013.01); *F02D 2200/701* (2013.01)

(58) Field of Classification Search
CPC ..... F02D 41/1445; F02D 2200/0402; F02D 2200/0414; F02D 2200/0616; F02D 2200/0406
See application file for complete search history.

(56) References Cited

U.S. PATENT DOCUMENTS

| | | | | |
|---|---|---|---|---|
| 7,269,495 | B2 * | 9/2007 | Katsumata | F02D 35/023 701/103 |
| 8,000,881 | B2 * | 8/2011 | Soejima | F02D 37/02 123/406.23 |
| 2015/0107550 | A1 * | 4/2015 | Remele | F02D 41/3047 123/304 |
| 2015/0330352 | A1 * | 11/2015 | Ishimori | F01P 7/162 123/142.5 R |

FOREIGN PATENT DOCUMENTS

| | | | |
|---|---|---|---|
| DE | 102010035026 | A1 | 2/2012 |
| FR | 2846373 | A1 | 4/2004 |
| WO | 2011119089 | A1 | 9/2011 |

* cited by examiner

METHOD FOR THE CORRECTION OF A FUEL QUANTITY INJECTED BY MEANS OF A FUEL INJECTION DEVICE DURING OPERATION OF AN INTERNAL COMBUSTION ENGINE

The present application is a 371 of International application PCT/EP2014/000171, filed Jan. 23, 2014, which claims priority of DE 10 2013 202 038.4, filed Feb. 7, 2013, the priority of these applications is hereby claimed and these applications are incorporated herein by reference.

BACKGROUND OF THE INVENTION

The invention pertains to a method for correcting a fuel quantity injected by means of a fuel injection device during operation of an internal combustion engine.

Methods of the type discussed here are known.

In internal combustion engines comprising at least one fuel injection device for injecting fuel into at least one combustion chamber of the internal combustion engine, parameters for actuating the fuel injection device are typically adapted to the conditions present when the engine is new. Especially as a result of wear or cavitation in the area of the fuel injection device, it is possible that, after a prolonged period of operation of the internal combustion engine, an excessive amount of fuel is injected. This is a problem, because the exhaust gas standards, especially upper limits for soot emission, can no longer be met. The fuel consumption of the internal combustion engine also increases as a result. It is possible, prior to the first start-up of the internal combustion engine, to store a calibration curve in an engine control unit, which curve anticipates the change in the quantity of injected fuel over time and correspondingly changes the actuation of the fuel injection device as a function of the operating time. This suffers from the disadvantage that the parameters for actuating the fuel injection device will be changed even if the amount of fuel being injected is not in fact excessive. According to an alternative, it is known that complicated methods can be carried out to determine the actual quantity of fuel being injected and to calculate a corresponding correction by means of intentional variation of the quantity of injected fuel and by observation of the resulting nonuniformity in the rpm's. Methods are also known which make use of complicated models of the fuel injection device, wherein the injected fuel quantities are corrected in particular by detection of the pressure in the accumulator for the fuel to be injected. All of these solutions are very elaborate and complicated.

German Offenlegungsschrift DE 10 2010 035 026 A1 describes a method for correcting the quantity of fuel injected by a fuel injection device in an internal combustion engine, in which a temperature of the exhaust gas of the internal combustion engine is measured, and a reference temperature of the exhaust gas is calculated by means of a temperature model. The measured and the calculated temperatures are compared, wherein the comparison leads to a temperature difference, which is used to determine a corrected value for the quantity of fuel to be injected. This method is cumbersome, because it is based on a complicated temperature model, wherein in particular it is also necessary to take into account a large number of correction variables.

SUMMARY OF THE INVENTION

The invention is therefore based on the goal of creating a method which makes it possible to correct, simply and quickly, the quantity of fuel being injected during the operation of an internal combustion engine.

The goal is achieved in a method in which a characteristic air heat variable is determined, on which an air heat flow supplied to at least one combustion chamber of the internal combustion engine functionally depends. At least one characteristic exhaust heat variable is determined, on which an exhaust heat flow, which is discharged by the at least one combustion chamber, functionally depends. With respect to both the air heat flow and exhaust heat flow, the concept of "functional dependence" means that relationship exists between the heat flow in question and the characteristic variable in question, such that a mathematical function can be stated which describes the heat flow as a function of the characteristic variable. A heat distribution factor is determined, which represents the quotient of the exhaust heat flow minus the air heat flow divided by the heat flow supplied to the combustion chamber by the injected fuel, i.e., by the mass flow of fuel supplied to the combustion chamber. What is involved here in particular is the quantity of heat which can be released the injected fuel by chemical reaction in the combustion chamber, as described by the heating value. In contrast, it is possible to ignore the comparatively small amount of heat attributable to the temperature of the injected fuel and its heat capacity. The fuel mass supplied to the internal combustion engine is calculated from the at least one characteristic air heat value, the at least one characteristic exhaust heat value, and the heat distribution factor. A comparison variable is calculated, which is obtained by comparing the calculated fuel mass value with a nominal fuel mass value. Finally, the actuation of the fuel injection device is adjusted as a function of a value of the comparison variable.

The method is based on a comparatively simple consideration of the heat flows passing through the at least one combustion chamber of the internal combustion engine. It is assumed that the combustion chamber is supplied with heat in essentially two ways, namely, by the supplied combustion air, which has a certain heat capacity and a certain temperature and therefore a certain heat content, and by the chemical energy of the injected fuel, wherein the heat flow supplied here is equal to the product of the quantity of fuel supplied per unit time multiplied by the heating value of the fuel. Heat or power is carried away from the at least one combustion chamber by essentially three mechanisms: A first mechanism pertains to the mechanical work performed by the combustion chamber. A second mechanism involves the quantity of heat which is carried away from the combustion chamber with the mass flow of exhaust gas, wherein the exhaust gas has a certain heat capacity and a certain temperature and therefore a certain heat content. Finally, a third mechanism addresses the fact that the combustion chamber loses heat through cooling, heat radiation, and convection. It is now assumed that, at least at a given load point of the internal combustion engine, the percentage distribution of the heat flows does not change even when the quantity of fuel actually injected changes as a result of aging. It is therefore possible to state a heat distribution factor, the value of which is independent of age-related changes in the quantity of fuel injected and which is described by the relationship of the quantity of heat carried away with the exhaust gas minus the quantity of heat supplied with the combustion air divided by the quantity of heat supplied by the fuel. The exhaust gas flow and the hot air flow can be stated as a function of the at least one characteristic air heat variable and as a function of the at least one characteristic exhaust heat variable. The heat flow which results from the injected fuel can be expressed as a function of the mass flow of fuel, i.e., of the injected fuel mass. Overall, it is therefore possible to state a functional relationship between the injected mass of fuel as a function of the characteristic air heat variable, the characteristic exhaust heat variable, and the heat distribution factor. When a value for the distribution factor is assumed and the values of the at least one characteristic air heat variable and of the characteristic exhaust heat variable are known, it is possible by means of this functional relationship to calculate the injected fuel mass. By comparing the calculated fuel mass with the nominal fuel mass value, it is then easy to obtain a comparison variable, on the basis of which the actuation of the fuel injection device can be corrected in order to compensate in particular for an age-related change in the quantity of fuel injected. The method can be carried out comparatively easily and quickly, wherein only a few variables must be known or assumed. The computing operations on which the method is based can also be carried out easily and quickly.

The method is preferably carried out by a control unit of the internal combustion engine or is implemented in such a control unit. The characteristic air heat variable and characteristic exhaust heat variable are preferably measured by sensors adapted to the purpose; it is especially preferable for these sensors to be functionally connected to the control unit for the transmission of the measurement values. The heat distribution factor is preferably stored in the control unit, wherein, to calculate the quantity of fuel injected, use is made of at least one stored value for the heat distribution factor.

A method is preferred which is characterized in that a first characteristic air heat variable is determined by measuring a combustion air temperature. "Combustion air temperature" is to be understood as the temperature of the mass flow of air being supplied to the at least one combustion chamber. It is obvious that the air heat flow is functionally dependent on the combustion air temperature. A second characteristic air heat value is preferably also determined by measuring the combustion air pressure. "Combustion air pressure" is to be understood as the pressure which prevails in the mass flow of air being supplied to the at least one combustion chamber. The mass flow of air itself depends on the combustion air temperature and the combustion air pressure by way of an equation of state, especially by way of the thermal equation of state for ideal gases, also called the ideal gas equation. The air heat flow in turn can be described as a function of the mass flow of air and the combustion air temperature under consideration of the heat capacity, especially of the isobaric heat capacity.

The method is preferably also carried out when an exhaust gas return is provided for the internal combustion engine. In this case, the mass flow of air comprises preferably the combustion air supplied to the combustion chamber and the mass flow of exhaust gas returned to the combustion chamber. In corresponding fashion, the air heat flow comprises both the quantity of heat of the combustion air and the quantity of heat of the returned exhaust gas. The combustion air temperature then means the temperature which prevails in the combined flow of combustion air and returned exhaust gas.

A method is preferred which is characterized in that a characteristic exhaust heat variable is determined by measuring an exhaust gas temperature. The exhaust gas temperature is the temperature of the mass flow of exhaust gas discharged by the at least one combustion chamber. The exhaust gas heat flow can then be described as a function of the mass flow of exhaust gas and the gas temperature under consideration of the heat capacity, especially of the isobaric heat capacity, of the exhaust gas.

The mass flow of exhaust gas is preferably formulated on the basis of the conservation of mass law as the sum of the mass flow of air and the mass flow of fuel, i.e., the injected fuel quantity. In a preferred embodiment of the method, the functional relationships addressed here are inserted into each other, and the resulting equation is solved for the mass of injected fuel.

It has been found in this way that, if one knows the combustion air temperature, the combustion air pressure, and exhaust gas temperature and that if one assumes a value for the heat distribution factor, one can easily calculate the injected fuel mass. Within the scope of the preferred embodiment of the method, the combustion air temperature, the combustion air pressure, and the exhaust gas temperature are measured for this purpose. Sensors can be used to do this, which are present in any case in the internal combustion engine. In an exemplary embodiment of the internal combustion engine which does have an exhaust gas temperature sensor, it would merely be necessary to add an additional sensor of this type to carry out the method.

It has been found that the calculation of the mass flow of air on the basis of the ideal gas law is not accurate enough under certain circumstances. To take into account deviations of the combustion air from the behavior of an ideal gas and possibly other corrections, a method is preferred in which the mass flow of air is calculated from the first and second characteristic air heat variables, i.e., from the combustion air temperature and the combustion air pressure, under consideration of a correction factor. In one embodiment of the method, the correction factor is estimated. In another embodiment of the method, the correction factor is determined on the basis of test bench experiments with a concrete model of the internal combustion engine.

A method is preferred which is characterized in that, as a comparison variable, the quotient of the calculated fuel mass divided by the nominal fuel mass value is calculated. What is calculated is therefore the factor by which the calculated mass flow of fuel, which is assumed to correspond to the quantity of fuel actually injected, deviates from the nominal fuel mass value. If the quotient is greater than one, the calculated value and thus also the assumed actual value deviate upward from the nominal value. If, conversely, the quotient has a value of less than one, the deviation is correspondingly downward. Within the scope of the method, a downward deviation is preferably tolerated, wherein an upward deviation indicates that a correction of the injected fuel quantity is necessary. The actuation of the fuel injection device is preferably adjusted only when the quotient has a value of greater than one. In this case, a characteristic curve of the injector, which describes the quantity of fuel to be injected as a function of the operating point, is adjusted, wherein this curve, in an especially preferred and simple embodiment of the method, is scaled by an adjustment factor which corresponds to the inverse of the quotient.

Alternatively or in addition, it is possible for the actuation of the fuel injection device also to be adjusted when the quotient has a value of less than one. In this case, trends or changes can also be taken into account which lead to a decrease in the quantity of fuel injected, such as that which occurs with increasing age of the internal combustion engine. In particular, the quantity of fuel injected can be automatically adjusted by means of the method to a predefinable nominal value also in cases where downward deviations are corrected.

A method is also preferred which is characterized in that the nominal fuel mass value is determined as a function of the current rotational speed and the current nominal torque of the internal combustion engine. The fuel quantity to be injected, which is preferably stored in the control unit, then depends on the rpm's of the internal combustion engine and on the torque required from the internal combustion engine. A engine map for the nominal fuel mass value is preferably stored; a nominal fuel mass value can thus be read out from this diagram as a function of the current rpm's and the current nominal torque and used to implement the method.

A method is also preferred which is characterized in that, upon the initialization of the method, the nominal fuel mass value is adjusted a single time with respect to the operating altitude of the internal combustion engine. Alternatively or in addition, the nominal fuel mass value is preferably adjusted a single time upon an initialization of the method with respect to the operating temperature of the internal combustion engine. The initialization of the method is preferably performed when the internal combustion engine is new by inputting data for the parameters of the method. Typical values for the nominal fuel mass value more-or-less characteristic of the internal combustion engine are corrected, preferably with respect to the operating altitude and/or the operating temperature of the internal combustion engine. The quantity of fuel to be injected at a certain rotational speed at a certain torque demand depends—in particular via the outside, ambient pressure—on the operating altitude of the internal combustion engine and also on the temperature typically reached by the internal combustion engine during operation, which in turn depends on the ambient temperature and/or on the cooling conditions. Especially in the case of stationary internal combustion engines used, for example, to operate generators for generating electricity, it is possible to predict the operating altitude and also the operating temperature reliably and over the long term.

A method is also preferred which is characterized in that the heat distribution factor is determined as a function of the at least one characteristic air heat variable. Alternatively or in addition, the correction factor is preferably determined as a function of the at least one characteristic air heat variable. A functional dependence of the heat distribution factor and/or of the correction factor on the combustion air temperature is preferably taken into account, wherein it is possible for an engine map to be stored in a control unit, in which values for the heat distribution factor and/or the correction factor as functions of the combustion air temperature are stored. A functional dependence of the heat distribution factor and/or of the correction factor on the combustion air pressure is also preferably taken into account, wherein preferably an engine map is stored in the control unit in which values for the distribution factor and/or the correction factor as a function of the combustion air pressure are stored. For the heat distribution factor and/or the correction factor, preferably a functional dependence both on the combustion air temperature and on the combustion air pressure is taken into account, wherein preferably an engine map is stored in the control unit which comprises values for the heat distribution factor and/or the correction factor as a function of the combustion air pressure and also of the combustion air temperature. It is possible for such values to be obtained by analysis or by means of test bench experiments.

A method is also preferred which is characterized in that it is carried out at only the operating point of the internal combustion engine at which the engine is producing maximum torque. This means in particular that the method is carried out only under full-load conditions, wherein only one nominal fuel mass value for the one operating point of maximum torque is stored. It is possible for this nominal fuel mass value to be corrected with respect to an operating altitude and/or an operating temperature of the internal combustion engine.

In principle, it is sufficient to carry out the method only under full-load conditions, because it can be assumed that a deviation of the injected fuel quantity occurring under full load will have the same or at least a very similar impact at other operating points of the internal combustion engine, so that the correction determined under full load is valid for the entire operating range of the internal combustion engine.

Alternatively, however, it is also possible to carry out the method at least at a few load points deviating from full-load conditions. It is especially preferable to conduct the method over the entire load range of the internal combustion engine. In this case, the heat distribution factor, the correction factor, and the nominal fuel mass value will be selected as a function of the current load point of the internal combustion engine. Corresponding engine maps in which values for the heat distribution factor, the correction factor, and the nominal fuel mass value as a function of the load point of the internal combustion engine are preferably stored in the control unit. The basic assumption of the method, that the heat distribution factor does not depend on the overall aging of the fuel injection device or of the internal combustion engine, remains unaffected. Merely the additional assumption is made that the heat distribution factor assumes different values at different load points of the internal combustion engine. The same is assumed for the correction factor. That the nominal fuel mass value depends on the load point of the internal combustion engine is obvious, because the overall fuel consumption of the internal combustion engine depends on the load point.

Finally, a method is preferred which is characterized in that the nominal fuel mass value is selected as a function of the at least one characteristic air heat variable and/or as a function of the current operating altitude and/or operating temperature of the internal combustion engine. Preferably, therefore, for the determination of the nominal fuel mass value, it is taken into account that this value depends on at least one variable, selected from the combustion air temperature, the combustion air pressure, the operating altitude, and the operating temperature of the internal combustion engine, especially on the ambient pressure. A engine map for the nominal fuel mass temperature in which values are stored as a function of at least one of the variables just mentioned is stored in the control unit.

The invention is explained in greater detail below on the basis of the drawing:

DETAILED DESCRIPTION OF THE INVENTION

Figure 1:
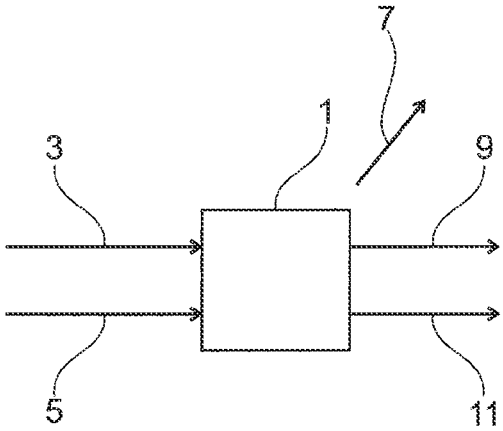
FIG. 1 shows a schematic diagram of a combustion chamber of an internal combustion engine and of the heat flows passing through it.

The basic idea on which the method is based is illustrated schematically in FIG. 1. Various heat flows pass through the combustion chamber 1, wherein it is assumed that the combustion chamber 1 acts neither as a heat source nor as a heat sink, so that all of the heat which enters the combustion chamber 1 leaves it again, wherein the temperature of the combustion chamber 1 remains constant at least as an approximation. Proceeding from the left in FIG. 1, an air heat flow 3 and a fuel heat flow 5 are shown, by means of which heat is supplied to the combustion chamber 1. The mass flow of fuel transporting the fuel heat flow 5 is also referred to here, as also previously and in the following, as the injected fuel mass or as the quantity of injected fuel, wherein these terms are preferably to be understood as relating to a single work cycle of the internal combustion engine. In particular, it is readily possible to convert the quantity of fuel injected per cycle to the fuel mass supplied per unit time to the combustion chamber, i.e., the mass flow of fuel. To obtain the heat flow $Q_{br}$ supplied to the combustion chamber 1 with the fuel, the fuel mass flow 5, also designated $m_{br}$, is multiplied by the net heating value $H_u$ of the fuel being used. We thus obtain the equation:

$$Q_{br}=m_{br}H_u. \tag{1}$$

Heat is carried away from the combustion chamber 1 by the mechanical work performed in it or by it, as illustrated schematically by a work heat flow 7. Heat is also removed from the combustion chamber 1 by an exhaust heat flow 9. Additional pathways by which heat is removed from the combustion chamber 1 are combined into a heat loss flow 11, wherein in particular the loss of heat by cooling, heat radiation, and convection are included.

The method is based on the assumption that the percentage distribution of the various heat flows remains at least approximately the same even after the injected fuel quantity changes as a result of aging. A heat distribution factor x is therefore assumed, which, as the quotient of the exhaust gas heat flow 9 designated $Q_A$ minus the air heat flow 3 designated $Q_L$ divided by the fuel heat flow $Q_{br}$, is found to be:

$$x=\frac{Q_A-Q_L}{Q_{br}}. \tag{2}$$

Figure 2:
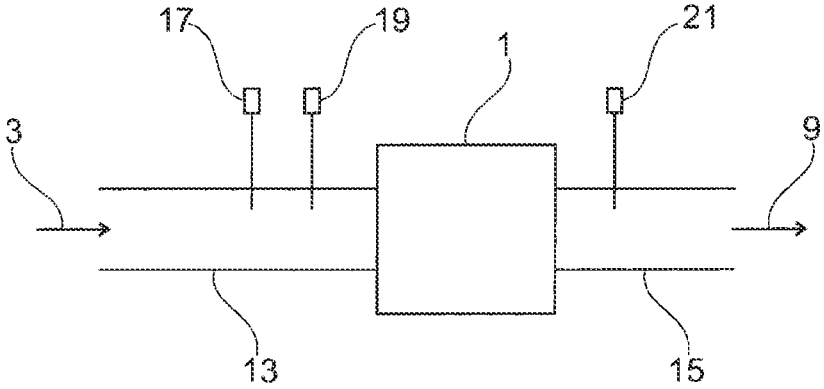
FIG. 2 shows a schematic diagram of a combustion chamber of an internal combustion engine with sensors, which are used to optimize the method.

FIG. 2 shows a schematic diagram of an exemplary embodiment of an internal combustion engine set up to optimize a preferred embodiment of the method. The combustion chamber 1 is shown again, to which an air heat flow 3 is supplied through a combustion air line 13, whereas the exhaust heat flow 9 is removed from the combustion chamber 1 by way of an exhaust gas line 15. A combustion air temperature sensor 17 for measuring the combustion air temperature as the first characteristic air heat variable is provided in the combustion air line 13. The combustion air temperature is designated $T_L$ in the following. A combustion air pressure sensor 19 for measuring the combustion air pressure as the second characteristic air heat variable is also provided in the combustion air line 13. The combustion air pressure is designated $p_L$ in the following. Finally, an exhaust temperature sensor 21, by means of which an exhaust temperature as the characteristic exhaust heat variable can be measured is provided in the exhaust gas line 15. The exhaust gas temperature is designated $T_A$ in the following.

The method is preferably carried out in an internal combustion engine configured as a reciprocating piston engine, wherein it is preferably operated according to the Diesel or the Otto method. Accordingly, the fuel which is used will be diesel fuel, gasoline, gas, especially lean gas, or some other suitable fuel. The internal combustion engine preferably comprises a plurality of combustion chambers, one for each cylinder.

Within the scope of the invention, an internal combustion engine is also preferred which is set up to implement the method. The internal combustion engine preferably comprises a device for determining at least one characteristic air heat variable, a device for determining at least one characteristic exhaust heat variable, and a device for calculating the injected fuel mass from the at least one characteristic air heat variable, for calculating the comparison variable, and for adjusting the actuation of the fuel injection device as a function of the value of the comparison variable. A preferred exemplary embodiment of the internal combustion engine also comprises in particular the combustion air temperature sensor 17, the combustion air pressure sensor 19, and the exhaust temperature sensor 21. The internal combustion engine also preferably comprises a control unit which is set up to implement the method and which in particular is functionally connected to the sensors 17, 19, 21.

An engine control unit is also preferably provided, in which the method according to one of the exemplary embodiments discussed here is implemented.

With respect to the sensors of the internal combustion engine, it has been found that, to implement the method, only the combustion air temperature sensor 17, the combustion air pressure sensor 19, and the exhaust temperature sensor 21 are provided. These sensors are already present in any case in many internal combustion engines, so that no additional sensors are required to implement the method. It is possible that an internal combustion engine is provided only with the combustion air temperature sensor 17 and the combustion air pressure sensor 19. To carry out the preferred embodiment of the method described here in this case, it is merely necessary to install one additional sensor, namely, the exhaust temperature sensor 21, on the internal combustion engine. It can thus be seen that the method can be carried out in particular with the help of only a few sensors, which are relatively uncomplicated, and most if not all of which are already present.

To calculate the injected fuel mass, the procedure described below is preferably followed:

An air mass flow $m_{L,id}$ ideally supplied to the combustion chamber 1 is obtained on the basis of the ideal gas law as a function of the combustion air temperature $T_L$, the combustion air pressure $p_L$, and the stroke volume $V_h$ of a combustion chamber of the internal combustion engine, multiplied by the number of combustion chambers, and the rotational speed in the internal combustion engine—preferably expressed as revolutions per second, wherein a cycle factor is taken into account, which states how many intake cycles the internal combustion engine completes per revolution of its crankshaft. In the following, the starting point, without limitation of its generality, is a four-cycle internal combustion engine, which means that the cycle factor is 0.5. Thus, overall, for the air mass flow $m_{L,id}$ ideally being supplied, the following equation is obtained using the ideal gas constant R:

$$m_{L,id}=\frac{p_L V_h Z}{RT_L}\frac{n}{2}. \tag{3}$$

To simplify the discussion, the stroke volume $V_h$, the number of combustion chambers Z, the rotational speed n, the universal gas constant R, and the cycle factor are combined in the following into a constant K:

$$K = \frac{V_h Zn}{2R}, \tag{4}$$

so that, after substituting Equation (4) in Equation (3), the following equation for the ideally supplied air mass flow $m_{L,id}$ is obtained:

$$m_{L,id} = K\frac{p_L}{T_L}. \tag{3'}$$

Deviations of the combustion air from ideal behavior and possibly other effects requiring a correction are taken into account by multiplying the ideal air mass flow $m_{L,id}$ by a correction factor λ to obtain the air mass flow $m_L$:

$$m_L = \lambda m_{L,id} = \lambda K\frac{P_L}{T_L}. \tag{5}$$

The exhaust mass flow $m_A$, under consideration of the conservation of mass law, is assumed to be the sum of the air mass flow $m_L$ and the fuel mass flow or the injected fuel mass $m_{br}$:

$$m_A = m_L + m_{br}. \tag{6}$$

It is now possible to express the exhaust heat flow $Q_A$ under consideration of the isobaric heat capacity of the exhaust gas $c_{p,A}$ as a function of the exhaust gas temperature $T_A$:

$$Q_A = m_A c_{p,A} T_A. \tag{7}$$

It is possible analogously to express the air heat flow $Q_L$ under consideration of the isobaric heat capacity of the combustion air $c_{p,L}$ as a function of the combustion air temperature $T_L$:

$$Q_L = m_L c_{p,L} T_L. \tag{8}$$

Overall, the following equation is obtained for the difference between the exhaust heat flow and the air heat flow:

$$Q_A - Q_L = \lambda K\frac{P_L}{T_L}c_{p,A}T_A + m_{br}c_{p,A}T_A - \lambda K\frac{p_L}{T_L}c_{p,L}T_L. \tag{9}$$

When we now insert Equation (9) and Equation (1) into Equation (2) and solve the resulting equation for the fuel mass flow $m_{br}$, we obtained the calculated fuel mass:

$$m_{br} = \frac{\lambda K\frac{P_L}{T_L}(c_{p,A}T_A - c_{p,L}T_L)}{xH_u - c_{p,A}T_A}. \tag{10}$$

It can therefore be seen that the injected fuel mass $m_{br}$ can be calculated from the measurement values of the combustion air temperature sensor 17, of the combustion air sensor 19, and of the exhaust temperature sensor 21, when values are assumed for the correction factor λ and the heat distribution factor x. The heat capacities of the exhaust gas $c_{p,A}$ and of the combustion air $c_{p,L}$ are preferably assumed as constant and are especially preferably stored in the control unit.

To correct the injected fuel quantity, a quotient k of the calculated fuel mass $m_{br}$ divided by a nominal fuel mass value ms is preferably calculated as a comparison variable:

$$k = \frac{m_{br}}{m_s}. \tag{11}$$

A characteristic injector curve comprising actuation parameters for the fuel injection device or values for the fuel mass to be injected is preferably stored in the control unit as a function of the load point, in particular as a function of the rotational speed and the torque demanded from the internal combustion engine. This characteristic injector curve is preferably corrected when the quotient k has a value greater than 1. Conversely, no correction of the characteristic injector curve is done when the value of the quotient k is less than or equal to 1. In an especially preferred embodiment of the method, the injector characteristic is scaled with an adjustment factor equal to the inverse of the quotient k.

In another embodiment of the method, the injector characteristic is always corrected whenever the quotient k has a value which is different from 1. In this case, too, the injector characteristic is preferably scaled with an adjustment factor which is the inverse of the quotient k.

In an especially simple embodiment of the method, a constant value is assumed for both the correction factor λ and for the heat distribution factor x. In another embodiment, it is possible to assume that the correction factor λ and/or the heat distribution factor x depend on the combustion air temperature $T_L$. Alternatively or in addition, it is possible to assume that the correction factor λ and/or the heat distribution factor x depend on the combustion air pressure $p_L$. The various pressure- and/or temperature-dependent values are preferably stored in engine maps. Alternatively or in addition, an analytical description of the dependent relationships is also possible, wherein the corresponding values are constantly being recalculated within the scope of the method.

The nominal fuel mass value ms is adjusted a single time with respect to an operating altitude and/or an operating temperature of the internal combustion engine upon the initialization of the method. In a different embodiment of the method, it is possible, either alternatively or in addition, for the nominal fuel mass value to be selected as a function of the combustion air temperature $T_L$ and/or of the combustion air pressure $p_L$, wherein, by way of these values, an operating altitude and an operating temperature of the internal combustion engine are taken implicitly into account. In another embodiment of the method, it is possible, alternatively or in addition, to take explicitly into account a dependence of the nominal fuel mass value ms on the current operating altitude and/or operating temperature of the internal combustion engine. The corresponding dependent values of the nominal fuel mass value ms are preferably stored in an engine map.

In one embodiment of the method, it is possible for the method to be carried out only when the internal combustion engine is operating under full load. In this case, the nominal fuel mass value ms is always a value which is assigned to the maximum torque of the internal combustion engine.

Alternatively, it is possible for the method to be carried out at least at a few operating points of the internal combustion engine which deviate from full-load conditions. It is especially preferable for the method to be carried out over the entire operating or load range of the internal combustion engine. In this case, the nominal fuel mass value ms depends on the current load point of the internal combustion engine. Load point-dependent values for the nominal fuel mass value ms are preferably stored in an engine map. If the method is carried out as a function of the load point, it preferable to take into account the dependence of the correction factor λ and/or of the heat distribution factor x on the load point. The corresponding values are preferably also stored in engine maps.

Experiments have shown that, by means of the method, it is possible accurately to determine deviations of the injected fuel mass of as little as 3% and to implement the corresponding corrections. The accuracy can be increased in particular by detailed consideration of the dependences of the heat distribution factor x and of the correction factor λ on the combustion air temperature $T_L$ and the combustion air pressure $p_L$.

It has thus been found overall that, by means of the method, it is possible, on the basis of a simple physical approach with the use of only three measurement values, to correct the quantity of fuel being injected by a fuel injection device during operation of an internal combustion engine without major effort.

The invention claimed is:

1. A method for correcting a fuel quantity injected by a fuel injection device during operation of an internal combustion engine, comprising the steps of:

determining at least one characteristic air heat variable, on which an air heat flow supplied to at least one combustion chamber of the internal combustion engine functionally depends;

determining at least one characteristic exhaust heat variable, on which an exhaust gas heat flow discharged by the at least one combustion chamber functionally depends;

determining a heat distribution factor that represents the exhaust heat flow minus the air heat flow divided by heat flow supplied by a mass flow of the injected fuel to the at least one combustion chamber;

calculating a fuel mass supplied to the internal combustion engine from the at least one characteristic air heat variable, the at least one characteristic exhaust heat variable, and the heat distribution factor; and calculating a comparison variable by comparing the calculated fuel mass with a desired fuel mass value and adjusting actuation of the fuel injection device as a function of a value of the comparison variable, including calculating a quotient as the comparison variable from the calculated fuel mass and the desired fuel mass value and adjusting the actuation of the fuel injection device only when the quotient has a value of greater than one.

2. The method according to claim 1, including determining a first characteristic air heat variable by measuring combustion air temperature as a temperature of an air mass flow supplied to the at least one combustion chamber.

3. The method according to claim 2, including determining a second characteristic air heat variable by measuring combustion air pressure as a pressure of the air mass flow supplied to the at least one combustion chamber.

4. The method according to claim 1, including determining a characteristic exhaust heat variable by measuring exhaust gas temperature as a temperature of an exhaust mass flow being discharged from the at least one combustion chamber.

5. The method according to claim 3, including calculating the air mass flow from the first and second characteristic air heat variables under consideration of a correction factor.

6. The method according to claim 1, including calculating a quotient as the comparison variable from the calculated fuel mass and the desired fuel mass value.

7. The method according to claim 1, including determining the desired fuel mass value as a function of current rotational speed and the current nominal torque of the internal combustion engine.

8. The method according to claim 7, wherein the desired fuel mass is taken from an engine map.

9. The method according to claim 1, including adjusting the desired fuel mass value a single time with respect to an operating altitude and/or an operating temperature of the internal combustion engine upon initialization of the method.

10. The method according to claim 5, including determining the heat distribution factor and/or the correction factor as a function of the at least one characteristic air heat variable.

11. The method according to claim 1, including carrying out the method at only one operating point of the internal combustion engine at which the internal combustion engine is delivering maximum torque.

12. The method according to claim 5, including carrying out the method at least at a few different load points, wherein the heat distribution factor, the correction factor, and the desired fuel mass value are selected as a function of a current load point.

13. The method according to claim 12, including carrying out the method over an entire operating range of the internal combustion engine.

14. The method according to claim 1, including selecting the desired fuel mass value as a function of the at least one characteristic air heat variable and/or as a function of a current operating altitude of the internal combustion engine.

* * * * *